US006085928A

United States Patent [19]

Dickinson et al.

[11] Patent Number: 6,085,928

[45] Date of Patent: Jul. 11, 2000

[54] STORAGE CONTAINER AND LATCH ASSEMBLY THEREFOR

[75] Inventors: Thomas Dickinson, St. Louis; Martin Shawn Egan, Ballwin; Harry Haggin, Eureka; Richard Brooks, Chesterfield, all of Mo.

[73] Assignee: Contico International, LLC, St. Louis, Mo.

[21] Appl. No.: 09/123,043

[22] Filed: Jul. 27, 1998

[51] Int. Cl.[7] ..... B65D 45/20; E05C 5/00

[52] U.S. Cl. ..... 220/324; 220/810; 292/113; 292/247

[58] Field of Search ..... 292/109, 113, 292/247; 220/324, 326, 315, 810

[56] References Cited

U.S. PATENT DOCUMENTS

| | | | |
|---|---|---|---|
| 4,782,673 | 11/1988 | Castelli et al. | 292/113 X |
| 5,024,471 | 6/1991 | Kahl et al. | 292/113 X |
| 5,127,684 | 7/1992 | Klotz et al. | 292/113 |
| 5,193,706 | 3/1993 | Hanna et al. | 220/324 |

*Primary Examiner*—Allan N. Shoap
*Assistant Examiner*—Niki M. Eloshway
*Attorney, Agent, or Firm*—Howell & Haferkamp, L.C.

[57] ABSTRACT

A latch assembly of the present invention comprises a link member and a latch body. The latch assembly is adapted for use with a storage container having a container body and a container lid connected to the container body. The container lid is connected to the container body in a manner to permit movement of the lid between open and closed positions relative to the container body. The link member is moveably connected to the container body. The latch body includes at least one lug and at least one retaining arm. The lug is integral with the latch body and has a lug recess adapted for receiving a first portion of the link member in a manner to permit pivoting movement of the link member relative to the lug. The retainer arm is integral with the latch body and is adapted for engaging the link member in a manner to prevent the link member from being released from the lug recess. The latch assembly is adapted for movement relative to the container body between a locked position and an unlocked position. When the latch assembly is in its locked position, the latch assembly engages the container body and the lid in a manner to maintain the lid in its closed position. When the latch assembly is in its unlocked position, the latch assembly is disengaged from the lid to permit movement of lid toward its open position.

26 Claims, 4 Drawing Sheets

STORAGE CONTAINER AND LATCH ASSEMBLY THEREFOR

BACKGROUND OF THE INVENTION

This invention relates generally to storage containers and, more particularly, to latch assemblies for storage containers that are adapted for maintaining a storage container lid in a closed position.

Many prior art storage containers have a cover or lid that is hingedly attached to a base or container body with latches being provided for maintaining the lid in a closed position on the container body. One such prior art latch assembly, sometimes referred to as an "over-the-center" latch assembly, typically comprises a latch handle and a link arm. One end of the link arm is pivotally connected to the container body and an opposite end of the link arm is pivotally connected to the handle. When in an open position, the handle hangs generally downwardly away from the container lid so that the container lid can be opened and closed without obstruction. When the handle is moved upwardly toward its closed position, it pivots on the link arm so that an upper portion of the handle can be brought into loose engagement with a locking notch in the container lid. Then, upon a slight downward movement of the handle, the link arm swings past the pivot point where the link arm is connected to the container body and a locking tab on the upper portion of the handle firmly engages the locking notch in the container lid to maintain the latch assembly in a locked position. To open the latch, one lifts the handle slightly to rotate the link arm away from the container body and then swings the handle upwardly so that the locking tab on the upper portion of the handle can be moved out of the locking notch and the handle can be moved away from the container lid.

In such "over-the-center" latch assemblies, the handle typically includes a plurality of lugs configured for receiving a portion of the link arm in a manner to permit pivoting movement of the link arm relative to the handle. Prior art storage containers that employ such latch assemblies often include analogous lugs which are configured for receiving the other end of the link arm in a manner to permit pivoting movement of the link arm and handle relative to the container. Typically, the lugs on the handle and container are of a somewhat resilient material that permits the link arm to be "snap-fit" into the lugs. Thus, to assemble the components of the latch assembly, the link arm is pressed into recesses in the lugs, and the connection is complete when the two members "snap" together. The handle and the link arm are connected to one another in like manner. The components of the latch assembly can be disassembled from one another by pulling the components apart or "un-snapping" them from one another.

A problem with such "over-the-center" latch assemblies is that the individual components of the latch assembly are susceptible to being snapped off from one another, particularly when the latch assembly is in an open position wherein the handle is hanging downwardly away from the container lid. Storage containers are sometimes subjected to environments where they are prone to being bumped. When the latch assemblies themselves get bumped or banged, the result is often that the individual components of the latch assembly are snapped off from one another.

SUMMARY OF THE INVENTION

The present invention overcomes this and other problems in the prior art by providing an improved storage container and an improved latch assembly. It is an object of the present invention to provide a latch assembly that is adapted to withstand being banged or bumped without the individual components of the latch assembly being separated from one another. It is another object to provide a latch assembly having hinge components that are adapted to resist being separated from the storage container when bumped. Still another object is to provide a latch assembly having components that are assembled in a snap-fit engagement. Yet another object is to provide a latch assembly having integral retaining components that prevent the latch assembly components from being inadvertently unsnapped from one another and that prevent the latch assembly components from being inadvertently unsnapped from the storage container.

In general, a latch assembly of the present invention comprises a link member and a latch body. The latch assembly is adapted for use with a storage container having a container body and a container lid connected to the container body. The container lid is connected to the container body in a manner to permit movement of the lid between open and closed positions relative to the container body. The link member is moveably connected to the container body. The latch body includes at least one lug and at least one retaining arm. The lug is integral with the latch body and has a lug recess adapted for receiving a first portion of the link member in a manner to permit pivoting movement of the link member relative to the lug. The retaining arm is integral with the latch body and is adapted for engaging the link member in a manner to prevent the link member from being released from the lug recess. The latch assembly is adapted for movement relative to the container body between a locked position and an unlocked position. When the latch assembly is in its locked position, the latch assembly engages the container body and the lid in a manner to maintain the lid in its closed position. When the latch assembly is in its unlocked position, the latch assembly is disengaged from the lid to permit movement of the lid toward its open position.

In another aspect of the present invention, a storage container comprises a container body, a container lid, a latch, at least one bearing, and at least one shoulder. The container lid is connected to the container body in a manner to permit movement of the lid between opened and closed positions relative to the container body. The latch is adapted for movement relative to the container body between a locked position and an unlocked position. The latch engages the container body and the lid in a manner to maintain the lid in its closed position when the latch is in its locked position. The latch is disengaged from the lid to permit movement of the lid toward its opened position when the latch is in its unlocked position. The latch includes a linking portion. The bearing is integral with the container body and has a bearing recess adapted for receiving the linking portion of the latch in a manner to permit pivoting movement of the latch relative to the bearing. The shoulder is integral with the container body and is adapted for engaging the latch in a manner to prevent the linking portion of the latch from being released from the bearing recess when the latch is in its unlocked position.

Other objects and features will be in part apparent and in part pointed out hereinafter.

BRIEF DESCRIPTIONS OF THE DRAWINGS

Corresponding reference characters indicate corresponding parts throughout the several views of the drawings.

DETAILED DESCRIPTION OF THE PREFERRED EMBODIMENTS

Figure 1:
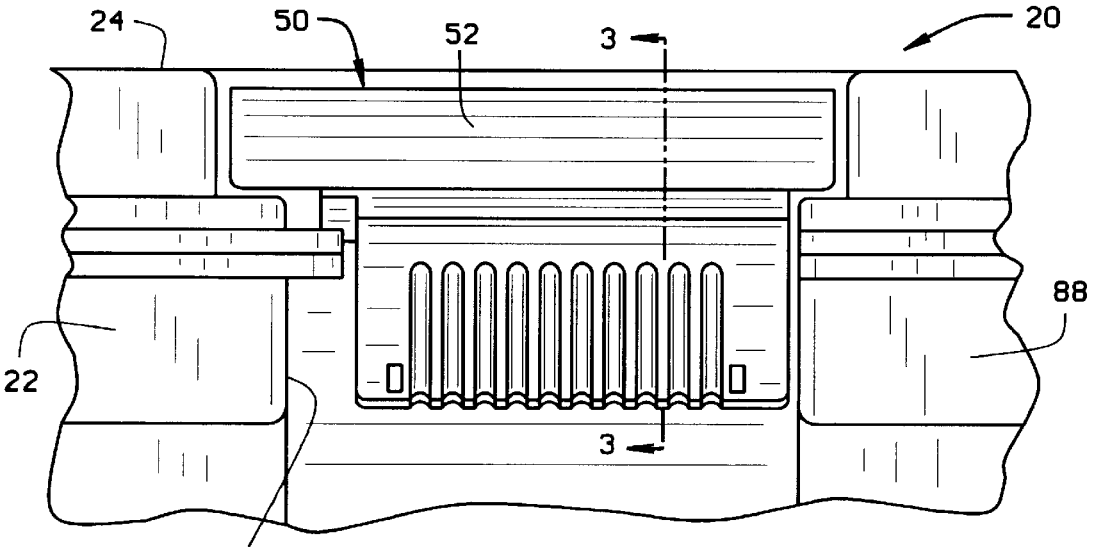
FIG. 1 is a fragmented, front elevational view of a storage container and latch assembly of the present invention.

The storage container of the present invention is represented generally by the reference numeral 20 in FIGS. 1, 2, 6 and 9. The storage container 20 includes a latch assembly, represented generally by the reference numeral 50.

The storage container 20 includes a container body 22 and a container lid 24 connected to the container body 22 in a manner to permit movement of the lid 24 between opened and closed positions relative to the container body 22. The container body is preferably defined by a generally rectangular bottom wall (not shown) and four side walls (not shown) extending upwardly from the periphery of the bottom wall to define an interior of the container, although the claimed invention could be used with containers having other configurations. In the preferred embodiment, the container lid 24 is hingedly connected to an upper end of one of the upwardly extending side walls and is pivotable relative to the container body 22 between its open and closed positions. In an alternative embodiment of the storage container (not shown), the container lid may be slidable, or moveable in yet another manner, relative to the container body, between its open and closed positions.

Figure 3:
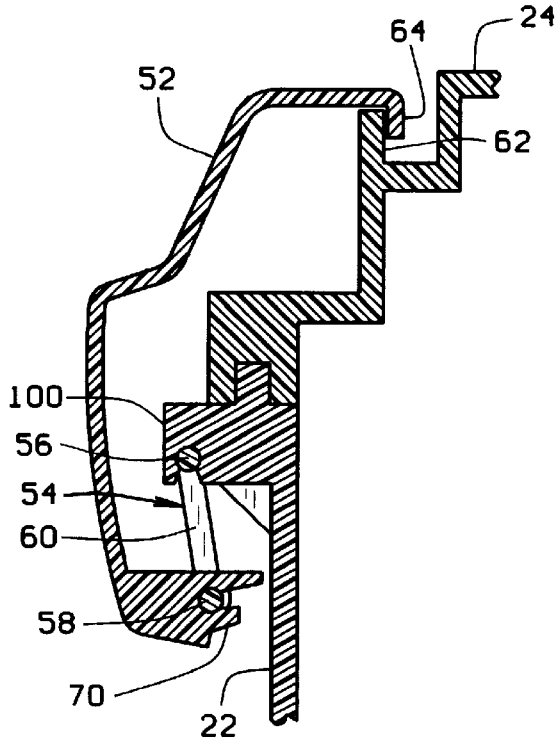
FIG. 3 is a fragmented, cross-sectional view taken along the plane of line 3—3 of FIG. 1 showing the latch assembly in a locked position.
Figure 4:
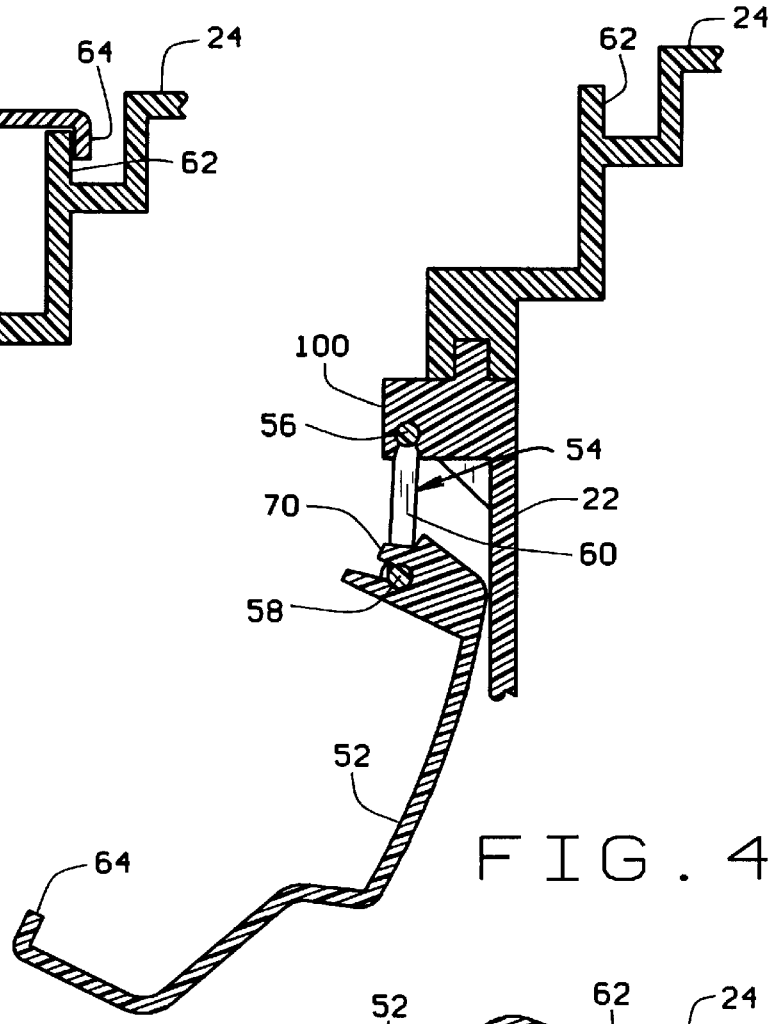
FIG. 4 is a fragmented, cross-sectional view similar to that of FIG. 3 but showing the latch assembly in an unlocked position.
Figure 5:
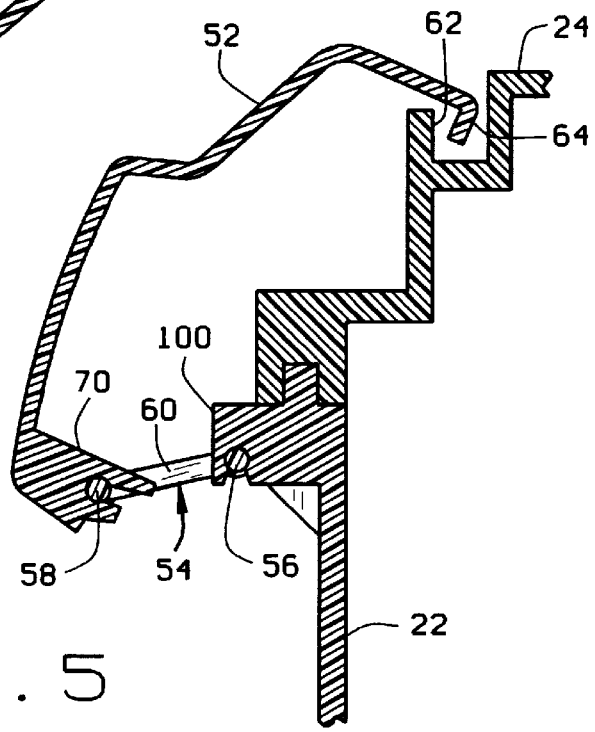
FIG. 5 is a fragmented, cross-sectional view similar to that of FIGS. 3 and 4 but showing the latch in loose engagement with the container lid and ready to be moved into the locked position.

The latch assembly 50, which is described below in more detail, is adapted for movement relative to the container body 22 between a locked position and an unlocked position. As shown in FIG. 3, the latch engages the container body and the lid in a manner to maintain the lid in its closed position when the latch is in its locked position. As shown in FIG. 5, the latch is disengaged from the lid to permit movement of the lid toward its opened position when the latch is in its unlocked position.

Figure 7:
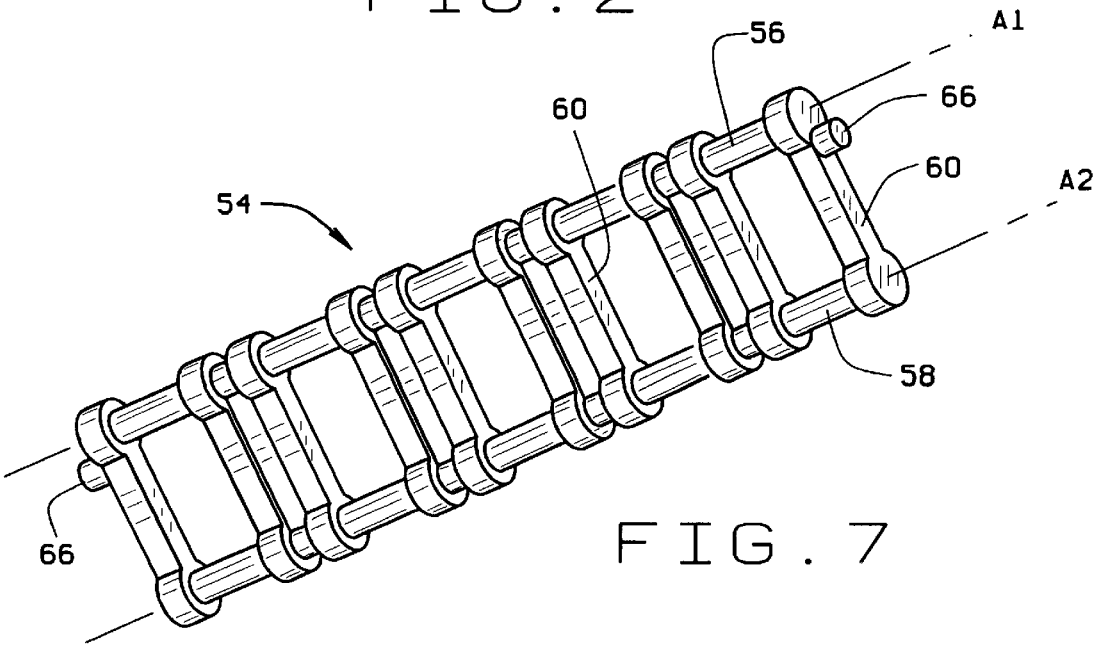
FIG. 7 is an enlarged perspective view of the link member shown in FIG. 6.

The latch assembly 50 is generally of the type that is sometimes referred to as an "over-the-center" latch assembly. As shown in FIGS. 3–6, the latch assembly 50 includes a latch body 52 and a link member 54. The latch body 52 is pivotally connected to the link member 54, and the link member 54 is, in turn, pivotally connected to the container body 22. The link member 54 is shown in more detail in FIG. 7. The link member 54 preferably includes a first pivot bar 56, a second pivot bar 58, and a plurality of cross members 60 connecting the first pivot bar 56 to the second pivot bar 58. In FIG. 7, the first pivot bar 56 is shown as extending generally along an axis A1 and the second pivot bar 58 is shown as extending generally along an axis A2. Preferably, the axes A1 and A2 are generally parallel to one another so that the first pivot bar 56 and the second pivot bar 58 are generally parallel to one another as shown in FIG. 7. The link member 54 also includes a pair of tabs 66. The tabs lie generally in a plane defined by axes A1 and A2, and preferably lie between the first pivot bar 56 and the second pivot bar 58 in that plane. The function of the tabs 66 is explained below.

As shown in FIGS. 3–6, the first pivot bar 56 is pivotally connected to the container body 22 so that the linking member 54 can be pivoted relative to the container body 22. Similarly, the second pivot bar 58 is pivotally connected to the latch body 52 so that the linking member 54 and the latch body 52 can be pivoted relative to one another. The connection of the first pivot bar 56 to the container body 22 and the connection of the second pivot bar 58 to the latch body 52 are both described below in more detail.

In operation of the latch assembly 50, the latch body 52 hangs generally downwardly away from the container lid 24 when the latch assembly is in its unlocked position (See FIGS. 4 and 6) so that the container lid 24 can be opened and closed without obstruction. The latch body 52 serves as a latch handle, with a lower portion of the latch body being adapted for manual engagement by a user's hand. When the latch body 52 is moved upwardly toward its closed position, it pivots on the link member 54 so that an upper portion of the latch body 52 can be brought into loose engagement with a locking notch 62 in the container lid 24 (See FIG. 5). Then, upon downward movement of the latch body 52, the link member 54 rotates inwardly about the first pivot bar toward the container body 22, just past the point where the first pivot bar 56 is connected to the container body 22 (See FIG. 3). In this position, a locking tab 64 on the upper portion of the latch body 52 firmly engages the locking notch 62 in the container lid 24 to maintain the latch assembly 50 in its locked position, and to maintain the container lid 24 in its closed position. To open the latch assembly 50, the latch body 52 is lifted upwardly and outwardly from the container body 22, which causes the linking member 54 to rotate in the reverse direction about the first pivot bar 56 and away from the container body 22. The locking tab 64 on the upper portion of the latch body 52 can then be moved out of the locking notch 62, and the latch body 52 can be moved away from the container lid 24 (back to the position shown in FIG. 4) so that the container lid can be moved toward its open position.

Figure 8:
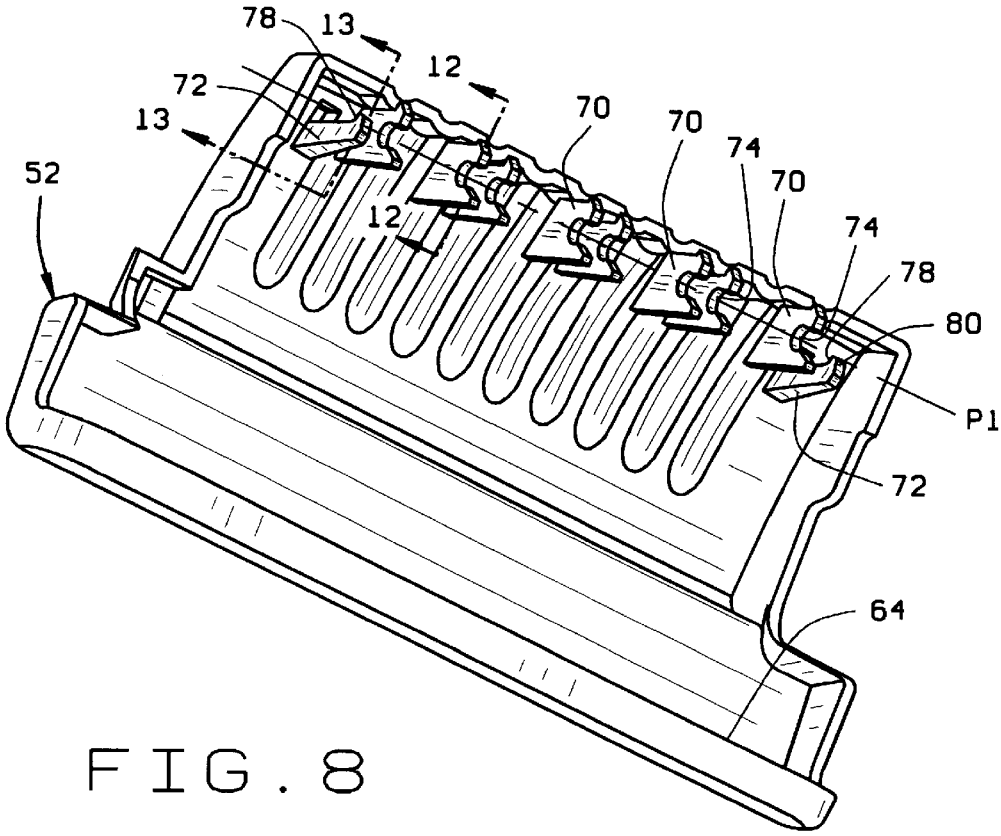
FIG. 8 is a perspective view of a rear side of the latch body shown in FIG. 6.
Figure 12:
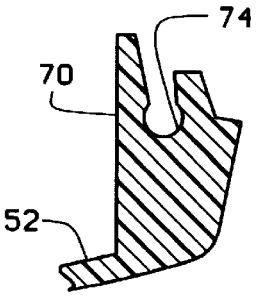
FIG. 12 is an enlarged, fragmented, cross-sectional view taken along the plane of line 12—12 of FIG. 8 showing detail of the lug.
Figure 13:
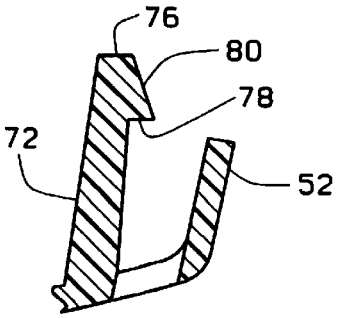
FIG. 13 is an enlarged, fragmented, cross-sectional view taken along the plane of line 13—13 of FIG. 8 showing detailed of the retaining arm.

As best shown in FIG. 8, the latch body 52 includes a plurality of lugs 70 extending outwardly from a rear side of the latch body 52. FIG. 12 is an enlarged, fragmented, cross-sectional view of one such lug 70 taken along the plane of line 12—12 in FIG. 8. The lugs 70 are integral with the latch body and, more preferably, the lugs 70 and the latch body 52 are of a monolithic piece. The latch body 52 also includes a pair of retaining arms 72, the purpose of which is explained below. FIG. 13 is an enlarged, fragmented, cross-sectional view of one such retaining arm 72 taken along the plane of line 13—13 in FIG. 8.

The lugs 70 each include a lug recess 74 adapted for receiving the second pivot bar 58 of the link member 54 in a manner to permit pivoting movement of the link member 54 relative to the lugs 70 and relative to the latch body 52. Preferably, the lug recesses 74 are adapted for receiving the second pivot bar 58 of the linking member 54 in a snap-fit connection. As shown in FIG. 8, the lug recesses 74 are all generally in line with one another with a central portion of each lug recess 74 falling along a first pivot axis P1. Preferably, the lugs 70 are of a resilient material that permits the second pivot bar 58 to be "snap-fit" into the lug recesses 74. Thus, to connect the latch body 52 and linking member 54 to one another, the second pivot bar 58 of the linking member 54 is pressed into the lug recesses 74. The resiliency of the lugs 70 permit the lug recesses 74 to expand slightly to accommodate the second pivot bar 58 as it is pressed into the lug recesses 74. The connection is complete when the two components "snap" together with the second pivot bar 58 fully received within the lug recesses 74 (i.e., with the axis A2 substantially co-linear with axis P1). As will be explained, the retaining arms 72 are adapted to prevent these components from becoming disassembled inadvertently. Thus, the linking member 54 and the latch body 52 cannot be disassembled from one another simply by pulling them apart or "unsnapping" them from one another.

The retaining arms 72 are integral with the latch body 52 and, more preferably, the retaining arms 72 and the latch body 52 are of a monolithic piece. The retaining arms 72 are adapted for engaging the second pivot bar 58 in a manner to prevent the link member 54 from being released from the lug recesses 74. As shown in FIG. 8, the retaining arms 72 are generally in line with the lugs 70. The retaining arms 72 are adapted to receive the second pivot bar 58 of the linking member 54 in a snap-fit connection as the second pivot bar is received within the lug recesses 74.

As shown in FIGS. 8 and 13, each retaining arm 72 extends outwardly from the rear side of the latch body generally in the same direction as the lugs 70 and terminates at a distal end 76. Each retaining arm 72 includes an abutting surface 78 adjacent its distal end 76. An open end of each lug recess 74 opens generally in a first direction facing away from the latch body 52 and the abutting surfaces 78 of the retaining arms 72 face a second direction generally opposite the first direction and generally toward the latch body 52. As best shown in FIG. 8, the abutting surfaces 78 are positioned relative to the lug recesses 74 so that the second pivot bar 58 is retained between the lug recesses 74 and the abutting surfaces 78 of the retaining arms 72. More particularly, the abutting surfaces 78 are positioned generally over the open end of the lug recesses 74 (i.e., overlapping pivot axis P1) so that the second pivot bar 58 is retained within the lug recesses 74 by the abutting surfaces 78.

The retaining arms 72 are configured so that the link member 54 and latch body 52 can be snapped together with relative ease. However, once these two components are snapped together, the retaining arms 72 engage the second pivot bar 58 in a manner to prevent the second pivot bar 58 from being inadvertently released from the lug recesses 74. Preferably, the retaining arms 72 are of a resilient material that permits movement of the retaining arms 72 relative to the latch body 52 between a first position wherein the abutting surfaces 78 of the retaining arms 72 are positioned generally over the open ends of the lug recesses 74 (i.e., overlapping axis A1) and a second position wherein the abutting surfaces 78 of the retaining arms 72 are spaced laterally from the pivot axis P1. Preferably, the resiliency of the retaining arms 72 biases them toward their first position. As best shown in FIG. 13, each retaining arm 72 includes a camming surface 80 adjacent to the abutting surface 78. The camming surface 80 is adapted for camming engagement with the second pivot bar 58. When the second pivot bar 58 is moved toward the latch body 52 and into the lug recesses 74, the second pivot bar 58 rides along the camming surfaces 80 of the retaining arms 72 toward the abutting surfaces 78 of the retaining arms 72, and this causes movement of the retaining arms 72 from their first position toward their second position against the bias of the retaining arms 72. Once the second pivot bar 58 is moved past the ends of the camming surfaces 80 to the abutting surfaces 78, the second pivot bar 58 is disengaged from the camming surfaces 80 and, due to their resiliency, the retaining arms 72 snap back to their first position with the abutting surfaces 78 positioned generally over the open ends of the lug recesses 74. Thus, the retaining arms 72 are adapted to receive the second pivot bar 58 of the link member 54 in a snap-fit connection as the second pivot bar 58 is received within the lug recesses 74. Accordingly, the retaining arms 72 engage the second pivot bar 58 in a manner so that the force required to snap fit the second pivot bar 58 into engagement with the retaining arms 72 is less than the force required to remove the second pivot bar 58 from the retaining arms 72.

Again, the lug recesses 74 are adapted for receiving the second pivot bar 58 of the linking member 54 in a snap-fit connection. The lug recesses 74 alone will provide at least some resistance to the link member 54 and the latch body 52 unsnapping from one another. The snap-fit connection of the lugs 70 with the second pivot bar 58, considered alone, is such that the force required to snap-fit the second pivot bar 58 into the lug recesses 74 is substantially the same as the force required to remove the second pivot bar 58 from the lug recesses 74. However, when the lug recesses 74 and retaining arms 72 are considered together, the force required to remove the second pivot bar 58 from the lug recesses 74 and retaining arms 72 is greater than the force required to snap-fit the second pivot bar 58 into the lug recesses 74 and retaining arms 72, and preferably significantly greater. Thus, under most normal conditions, where the storage container 20 is subjected to environments that may result in the latch assembly 50 getting bumped or banged, the retaining arms 72 will prevent the link member 54 from being inadvertently unsnapped from the latch body 52.

Figure 2:
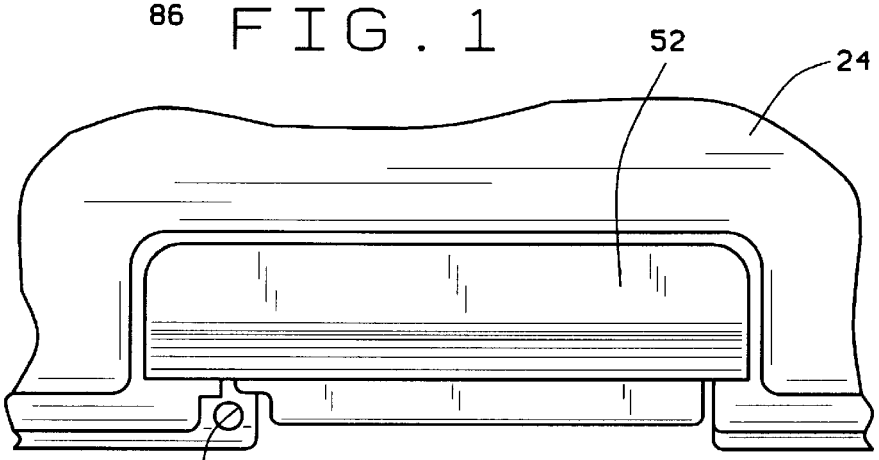
FIG. 2 is a fragmented, top plan view of the storage container and latch assembly of FIG. 1.
Figure 6:
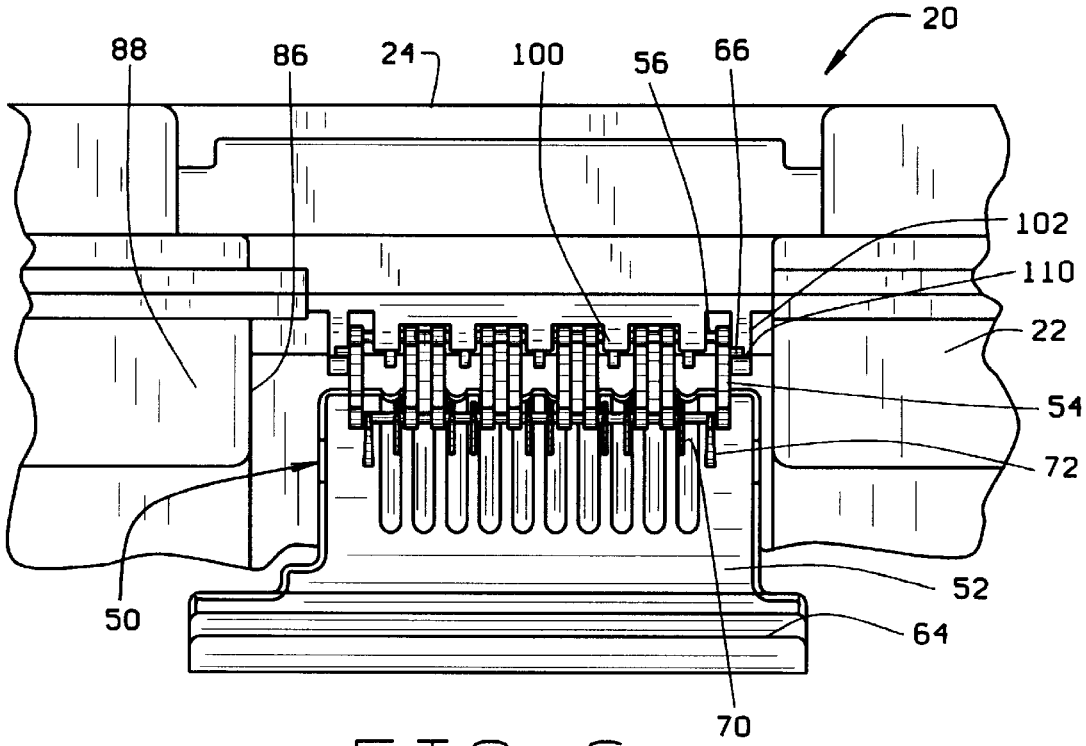
FIG. 6 is a fragmented, front elevational view of the storage container and latch assembly of FIG. 1 with the latch assembly in its unlocked position to show the link member.
Figure 9:
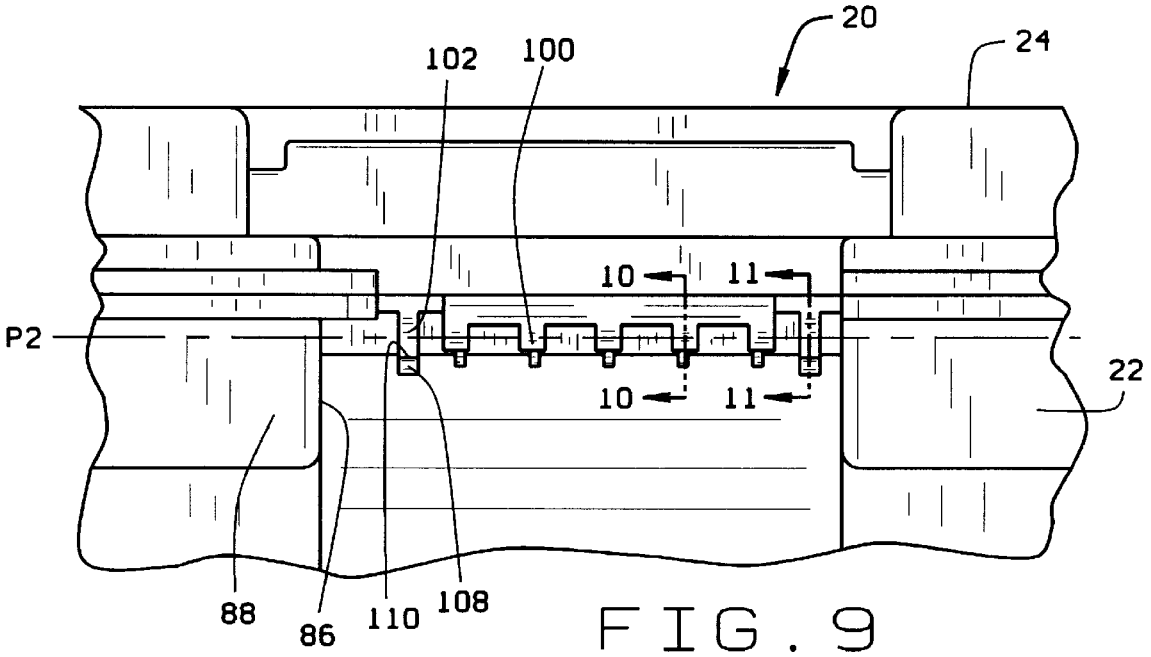
FIG. 9 is a fragmented, front elevational view of the storage container of FIG. 1 with the latch assembly removed.

As shown in FIGS. 1, 6 and 9, the storage container body 22 includes a recessed area 86 sized to accommodate the latch assembly 50 so that the latch assembly is generally in line with the front wall 88 of the container body 22. As shown in FIG. 2, the container lid includes a hole 90 adjacent the recessed area 86. The hole 90 is sized for receiving a lock (not shown) for locking the container lid 24 to the container body 22. The container body 22 includes a similar hole (not shown) in register with the hole 90 in the container lid. As best shown in FIGS. 1 and 2, the side of the latch body 52 nearest the hole 90 (the left side when looking at FIGS. 1 and 2) is cut away to accommodate a standard pad lock or any another similar locking device.

Figure 10:
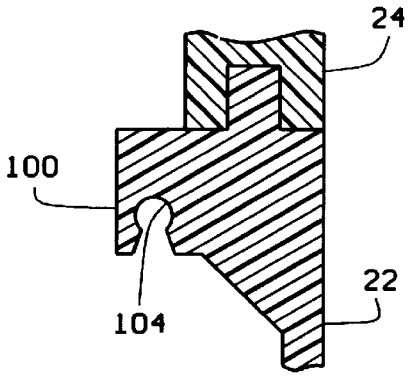
FIG. 10 is an enlarged, fragmented, cross-sectional view taken along the plane of line 10—10 of FIG. 9 showing detail of the bearing.
Figure 11:
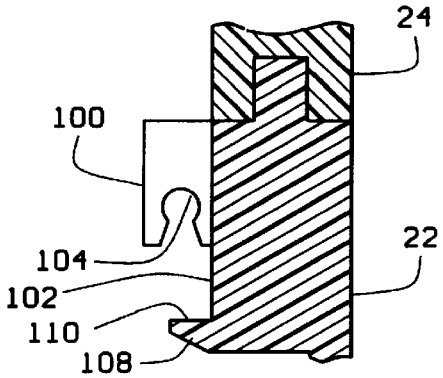
FIG. 11 is an enlarged, fragmented, cross-sectional view taken along the plane of line 11—11 of FIG. 9 showing detail of the shoulder.

As shown in FIG. 9, the storage container body 22 includes a plurality of bearings 100 extending outwardly from the front wall 88 of the container body 22. FIG. 10 is an enlarged, fragmented, cross-sectional view of one such bearing 100 taken along the plane of line 10—10 in FIG. 9. The bearings 100 are integral with the container body 22 and, more preferably, the bearings 100 and the container body 22 are of a monolithic piece. The container body 22 also includes a pair of generally L-shaped retaining shoulders 102, the purpose of which is explained below. FIG. 11 is an enlarged, fragmented, cross-sectional view of one such shoulder 102 taken along the plane of line 11—11 in FIG. 9.

The bearings 100 each include a bearing recess 104 adapted for receiving the first pivot bar 56 of the link member 54 in a manner to permit pivoting movement of the link member 54 relative to the bearings 100 and relative to the container body 22. Preferably, the bearing recesses 104 are adapted for receiving the first pivot bar 56 of the linking member 54 in a snap-fit connection, similar to the snap-fit connection of the second pivot bar 58 and the lugs 70 described above. As shown in FIG. 9, the bearing recesses 104 are all generally in line with one another. A central portion of each bearing recess 104 falls generally along a second pivot axis P2. Preferably, the bearings 100 are of a somewhat resilient material that permits the first pivot bar 56 to be "snap-fit" into the bearing recesses 104. Thus, to connect the link member 54 to the container body 22, the first pivot bar 56 of the linking member 54 is pressed into the bearing recesses 104. The resiliency of the bearings 70 permit the bearing recesses 104 to expand slightly to accommodate the first pivot bar 56 as it is pressed into the bearing recesses 104. The connection is complete when the link member 54 and the container body 22 "snap" together with the first pivot bar 56 fully received within the bearing recesses 104 (i.e., with the axis A1 substantially co-linear with axis P2). As will be explained, the shoulders 102 are adapted to prevent the link member 54 from becoming inadvertently disassembled from the container body 22, especially when the latch assembly is in its more vulnerable unlocked position with the latch body 52 hanging generally downwardly.

The shoulders 102 are integral with the container body 22 and, more preferably, the shoulders 102 and the container body 102 are of a monolithic piece. As will be explained, the shoulders 102 are adapted for engaging the tabs 66 of the link member 54 in a manner to prevent the link member 54 from being released from the bearing recesses 104 when the latch assembly is in its unlocked position. As shown in FIG. 9, the shoulders 102 preferably flank the bearings 100, and a lower portion 108 of each shoulder 102 hangs just below the bearings 100 and just below axis P2.

As best shown in FIG. 11, an open end of each of the bearing recesses 104 preferably opens generally downwardly and the lower portion 108 of each shoulder 102 includes an abutting surface 110 facing generally upwardly. The abutting surfaces 110 of the shoulders 102 are spaced a distance from axis P2 so that the abutting surfaces 110 are engageable with the tabs 66 when the latch assembly 50 is in its unlocked position with the link member 54 hanging generally vertically (See FIG. 4). As shown in FIG. 6, when the latch assembly 50 is in its unlocked position, the abutting surfaces 100 are engageable with the tabs 66 in a manner to retain the first pivot bar 56 within the bearings 100. Thus, the shoulders 102 are positioned and adapted for engaging the tabs 66 in a manner to prevent the first pivot bar 56 from being released from the bearing recesses 104 when the latch assembly 50 is in its unlocked position. Under most any normal conditions, where the storage container 20 is subjected to environments that may result in the latch assembly 50 getting bumped or banged, the shoulders 102 will prevent the link member 54 from being inadvertently unsnapped from the container body 22.

Although the above description is of the preferred embodiments of the storage container 20 and latch assembly 50 of the present invention, alternative embodiments of the storage container and latch assembly could be provided without departing from the scope of the invention. For example, the storage container 20 has been shown and described as employing generally L-shaped retaining shoulders 102 for engaging tabs 66 on the link member 54 for preventing the first pivot bar 56 from being inadvertently unsnapped from the bearings 100. However, in an alternative embodiment, the storage container 20 could employ resilient retaining arms (similar in structure and function to the retaining arms 72 of the latch body 52) in place of the shoulders 102, to serve the function of preventing the first pivot bar 56 from being inadvertently unsnapped from the bearings 100. Similarly, the latch assembly 50 has been described as having a pair of resilient retaining arms 72 for engaging the second pivot bar 58 in a manner for preventing the second pivot bar 58 from being inadvertently unsnapped from the lugs 70. However, in an alternative embodiment, the latch assembly 50 could employ shoulders (similar in structure and function to the shoulders 102 of the container body 22) in place of the retaining arms 72, to serve the function of preventing the second pivot bar 58 from being inadvertently unsnapped from the latch body 52.

In view of the above, it will be seen that the objects of the invention have been achieved and other advantageous results attained. As various changes could be made without departing from the scope of the invention, it is intended that all matter contained in the above description or shown in the accompanying drawings shall be interpreted as illustrative and not in a limiting sense.

What is claimed is:

1. A latch assembly for use with a storage container having a container body and a container lid connected to the container body in a manner to permit movement of the lid between open and closed positions relative to the container body, the latch assembly comprising:

a link member adapted to be moveably connected to the container body; a latch body;

at least one lug integral with the latch body, the lug having a pair of projections projecting from the latch body generally in a first direction, the pair of projections being spaced from one another to define a lug recess therebetween, the lug recess being adapted for receiving a first portion of the link member in a snap-fit connection that permits pivoting movement of the link member relative to the lug, an open end of the lug recess opening generally in the first direction, the lug recess having a central portion approximately midway between the pair of projections; and at least one retaining arm integral with the latch body and adjacent the pair of projections of the lug, the retaining arm being adapted for engaging the link member in a manner to prevent the link member from being released from the lug recess, the retaining arm having an abutting surface facing in a second direction generally opposite the first direction, at least a portion of the abutting surface being positioned generally over the open end of the lug recess and overlapping the central portion of the lug recess in a manner to prevent the link member from moving in the first direction out of the lug recess;

the latch assembly being adapted for movement relative to the container body between a locked position and an unlocked position, the latch assembly being adapted for engaging the container body and the lid in a manner to maintain the lid in its closed position when the latch assembly is in its locked position, the latch assembly being disengaged from the lid to permit movement of the lid toward its open position when the latch assembly is in its unlocked position.

2. The latch assembly of claim 1 wherein the retaining arm is adapted to receive a second portion of the link member in a snap-fit connection as the first portion of the link member is received within the lug recess.

3. The latch assembly of claim 2 wherein the retaining arm is adapted to engage the second portion of the link member in a manner so that the force required to snap fit the second portion of the link member into engagement with. the retaining arm is less than the force required to remove the second portion of the link member from the retaining arm.

4. The latch assembly of claim 3 wherein the lug recess is adapted to engage the first portion of the link member in a manner so that the force required to snap-fit the first portion of the link member into the lug recess is substantially the same as the force required to remove the first portion of the link member from the lug recess, not counting the force required to remove the second portion of the link member from the retaining arm.

5. The latch assembly of claim 1 wherein the link member includes a pivot bar, the lug recess being adapted for receiving the pivot bar in a manner to permit pivoting movement of the link member relative to the lug, the retaining arm being adapted for engaging the pivot bar in a manner to prevent the pivot bar from being released from the lug recess.

6. The latch assembly of claim 5 wherein the retaining arm is adapted for resilient movement relative to the latch body between a first position wherein the abutting surface is positioned generally over the open end of the lug recess and a second position wherein the abutting surface is spaced laterally from the open end of the lug recess, the retaining arm being biased toward the first position.

7. The latch assembly of claim 6 wherein the retaining arm includes a camming surface adjacent to the abutting surface, the camming surface being adapted for camming engagement with the pivot bar in a manner so that movement of the pivot bar in the second direction toward the lug recess causes movement of the retaining arm toward its second position against the bias of the retaining arm.

8. The latch assembly of claim 7 wherein the bias of the retaining arm causes the retaining arm to snap back to its first position when the pivot bar has been received within the lug recess and has disengaged the camming surface of the retaining arm.

9. The latch assembly of claim 1 wherein the retaining arm constitutes a first retaining arm, and wherein the latch assembly further comprises a second retaining arm.

10. The latch assembly of claim 1 wherein the lug is one of a plurality of such lugs, each lug of the plurality of lugs having a lug recess adapted for receiving a portion of the link member in a manner to permit pivoting movement of the link member relative to the latch body.

11. The latch assembly of claim 1 wherein the lug and the latch body are of a monolithic piece.

12. The latch assembly of claim 1 wherein the retaining arm and the latch body are of a monolithic piece.

13. A storage container having a latch assembly as set forth in claim 1, the storage container comprising:

a container body; and a container lid connected to the container body in a manner to permit movement of the lid between open and closed positions relative to the container body;

the latch assembly being connected to the container body.

14. A storage container comprising:

a container body;

a container lid connected to the container body in a manner to permit movement of the lid between open and closed positions relative to the container body;

a latch adapted for movement relative to the container body between a locked position and an unlocked position, the latch engaging the container body and the lid in a manner to maintain the lid in its closed position when the latch is in its locked position, the latch being disengaged from the lid to permit movement of the lid toward its open position when the latch is in its unlocked position, the latch including a linking portion;

at least one bearing integral with the container body, the bearing having a pair of projections projecting from the container body generally in a first direction, the pair of projections being spaced from one another to define a bearing recess therebetween, the bearing recess being adapted for receiving the linking portion of the latch in a snap-fit engagement that permits pivoting movement of the latch relative to the bearing, an open end of the bearing recess opening generally in the first direction, the bearing recess having a central portion approximately midway between the pair of projections; and at least one shoulder integral with the container body and generally adjacent the pair of projections of the bearing, the shoulder having an abutting surface facing a second direction generally opposite the first direction, at least a portion of the abutting surface being positioned generally over the open end of the bearing recess and overlapping the central portion of the bearing recess in a manner to prevent the linking portion of the latch from moving in the first direction out of the bearing recess when the latch is in its unlocked position.

15. The storage container of claim 14 wherein the latch includes a tab projecting therefrom, the abutting surface of the shoulder being adapted for engaging the tab in a manner to prevent the linking portion of the latch from being released from the bearing recess when the latch is in its unlocked position.

16. The storage container of claim 15 wherein the linking portion includes a first pivot bar that extends along a first axis, and wherein the tab is spaced from the first axis.

17. The storage container of claim 16 wherein the bearing recess is adapted for receiving the first pivot bar in a manner to permit pivoting movement of the first pivot bar relative to the bearing, the shoulder being positioned and adapted for engaging the tab in a manner to prevent the first pivot bar from being released from the bearing recess when the latch is in its unlocked position.

18. The storage container of claim 17 wherein the latch includes a handle portion connected to the linking portion for pivoting movement relative thereto.

19. The storage container of claim 18 wherein the linking portion includes a second pivot bar spaced from the first pivot bar and at least one cross member connecting the first and second pivot bars, and wherein the handle portion of the latch includes at least one lug having a lug recess adapted for receiving the second pivot bar in a manner to permit pivoting movement of the linking portion relative to the handle portion.

20. The storage container of claim 19 wherein the second pivot bar extends along a second axis spaced from and parallel to the first axis, and wherein the tab lies in a plane defined by the first and second axes.

21. The storage container of claim 20 wherein the tab lies in the plane between the first and second axes.

22. The storage container of claim 14 wherein the shoulder constitutes a first shoulder and wherein the storage container further comprises a second shoulder.

23. The storage container of claim 14 wherein the bearing is one of a plurality of such bearings, each bearing of the plurality of bearings having a bearing recess adapted for receiving the linking portion of the latch in a manner to permit pivoting movement of the latch relative to the container body.

24. The storage container of claim 14 wherein the bearing and the container body are of a monolithic piece.

25. The storage container of claim 14 wherein the shoulder and the container body are of a monolithic piece.

26. A latch assembly for use with a storage container having a container body and a container lid connected to the container body in a manner to permit movement of the lid between open and closed positions relative to the container body, the latch assembly comprising:

a link member adapted to be moveably connected to the container body;

a latch body;

at least one lug integral with the latch body, the lug having a lug recess adapted for receiving a first portion of the link member in a snap-fit connection; and at least one retaining arm integral with the latch body, the retaining arm being adapted for receiving a second portion of the link member in a snap-fit connection as the first portion of the link member is received within the lug recess;

the retaining arm being adapted to engage the second portion of the link member in a manner so that the force required to snap-fit the second portion of the link member into engagement with the retaining arm is less than the force required to remove the second portion of the link member from the retaining arm;

the lug recess being adapted to engage the first portion of the link member in a manner so that the force required to snap-fit the first portion of the link member into the lug recess is substantially the same as the force required to remove the first portion of the link member from the lug recess, not counting the force required to remove the second portion of the link member from the retaining arm;

the force required to remove the second portion of the link member from the retaining arm being greater than the force required to remove the first portion of the link member from the lug recess, whereby the retaining arm prevents the first portion of the link member from being released from the lug recess;

the latch assembly being adapted for movement relative to the container body between a locked position and an unlocked position, the latch assembly being adapted for engaging the container body and the lid in a manner to maintain the lid in its closed position when the latch assembly is in its locked position, the latch assembly being disengaged from the lid to permit movement of the lid toward its open position when the latch assembly is in its unlocked position.

* * * * *